United States Patent [19]

Groschupp et al.

[11] Patent Number: 4,697,522

[45] Date of Patent: Oct. 6, 1987

[54] DRAWN MINE-REMOVING APPARATUS

[75] Inventors: Karl-Heinz Groschupp, Seevetal, Fed. Rep. of Germany; Simon P. Vreeke, CK s'Gravenpolder, Netherlands

[73] Assignee: Kabelwerke Friedrich C. Ehlers, Hamburg, Fed. Rep. of Germany

[21] Appl. No.: 865,545

[22] Filed: May 20, 1986

[30] Foreign Application Priority Data

May 21, 1985 [DE] Fed. Rep. of Germany ..... 3522197

[51] Int. Cl.[4] ..... B41B 1/04

[52] U.S. Cl. ..... 102/402; 114/247; 114/254

[58] Field of Search ..... 102/402; 114/243, 247, 114/253, 254; 367/106, 130

[56] References Cited

U.S. PATENT DOCUMENTS

| | | | |
|---|---|---|---|
| 3,826,215 | 7/1974 | Dyjak | 102/402 |
| 3,906,884 | 9/1975 | Gould | 102/402 |
| 4,186,663 | 2/1980 | Curtis | 102/402 |

*Primary Examiner*—Charles T. Jordan

*Attorney, Agent, or Firm*—Michael J. Striker

[57] ABSTRACT

A mine-removing apparatus to be drawn behind a mine-sweeping boat and comprising a pulling cable pulling a sound generator for igniting acoustic mines, and electrode-carrying floating cables or an electrically-conductive floating cable loop for igniting magnetic mines, wherein said pulling cable and said floating cables extend in the region close to the boat as a common strand permitting limited longitudinal displacement of said cables relative to each other, said pulling cable extends beyond the trailing end of said floating cables, and all cables can be wound on and off a single winch on the boat stern.

9 Claims, 3 Drawing Figures

DRAWN MINE-REMOVING APPARATUS

BACKGROUND OF THE INVENTION

The present invention relates to a draawn mine-removing apparatus with at least one mechanically or electrically driven sound generator for igniting acoustical mines, and electrode-carrying floating cables for igniting magnetic mines.

Mine-removing apparatus of the foregoing type have been utilized for igniting sea mines. Such an apparatus has been designed to ignite mines having magnetic detonators, which normally react to fluctuations of local magnetic fields, such that occur when large magnetizable objects, like a ship hull approach the mine. Such apparatus have been also designed to ignite mines provided with acoustic detonators, which react to sound waves generated by the ship drives, and also so-called combined or magneto-acoustic mines which react to changes in local magnetic fields in combination with acoustic signals.

In conventional mine-removing apparatus of the type under consideration the electrode-carrying floating cables or a closed electrically-conductive floating cable loop and a mechanically or electrically driven sound generator are towed by rigid cables or ropes connected to a mine sweeping boat, wherein the length of the pulling cables or ropes can be between 300 and 600 m without any danger. For a magnetic ignition of mines, a voltage is applied to the electrode-carrying floating cable or the closed floating cable loop so that a magnetic field is generated between the electrodes—the circuit is closed by water—or about the floating cable loop. This field changes the local magnetic field around a ground mine and thus ignites the latter. For an acoustic ignition of mines, a sound generator towed by the mine-sweeping boat, is normally provided. The sound generator is normally electrically or mechanically driven. This generator produces a pulsing noise which resembles the noise made by the drive of a ship so that an acoustic mine is ignited.

With conventional devices, the apparatus for magnetic mine ignition put out and pulled in by means of a motor-operated winch is drawn in a straight line behind the mine-sweeping boat. The sound generator is driven and drawn separately by a second motor-operated winch on a separate cable, which must be kept lateral diverted from the magnetic mine-ignition device. For this purpose a plurality of floatable diverter kites are provided on the cable of the sound generator.

These conventional devices are expensive, as they require separate motor-operated winches and it is difficult and time-consuming to put out or pull in these devices, particularly in rough sea. For ensuring a parallel arrangement at a certain distance of the cables, special diverter kites must be provided on the cable of the sound generator. The maneuvering ability of the mine-sweeping boat and the visual control of the mine-removing apparatus leaves much to be desired. In case of combined ground mines which react to magnetic and acoustic signals, the known mine-removing apparatus is not able to ensure a reliable ignition of the mines, because modern combined sea mines due to the lateral distance between the sound generator and the field source can discriminate between a ship and the mine-removing apparatus.

SUMMARY OF THE INVENTION

It is an object of the present invention to provide an improved mine-removing apparatus which would ensure by simple means a reliable ignition of undersea mines.

This and other objects of the invention are attained by a mine-removing apparatus drawn by and positioned behind a mine-sweeping boat and comprising a pulling cable, at least one sound generator connected to said pulling cable and adapted for igniting acoustic mines, and electrode-carrying floating cables or an electrically-conductive floating cable loop for igniting magnetic mines, wherein said pulling cable has a first portion close to the boat, at least said first portion and said floating cables extending as a common strand; said floating cables have a trailing end and said pulling cable has a length extending in operation beyond said trailing end, said pulling cable has a length in operation beyond said trailing end; and said pulling cable and said floating cables are guided for limited longitudinal displacement relative to each other.

In the mine-removing apparatus according to the invention the pulling cable and the electrode-carrying floating cables or the floating cable loop are combined at least in the region close to the boat to a common strand. The sound generator hangs at the trailing end of the pulling cable extending beyond the floating cables. Thereby both mine-igniting devices are towed behind the mine-sweeping boat in a straight line so that a clear configuration results, which can be put out and pulled in with about half the time and effort. Expensive and difficult-to-handle diverting kites are no longer necessary. The field source and the sound generator are positioned one straight behind the other and correspond practically in an ideal manner to an imitated ship. It is therefore ensure that contemporary ground mines would not distinguish between the mine-removing apparatus and actual ships. For handling the mine-removing apparatus only one motor-operated winch is required. The mine-sweeping boat can be easily maneuvered also with the towed mine-removing apparatus of the invention. Due to the limited relative displaceability of the pulling cable and the floating cables variations in the mechanical forces acting on the pulling cable do not influence the floating cables.

The floating cables in the region close to the boat may be twined around said pulling cable.

The floating cables may have in the region close to the boat a pulling sleeve and said pulling cable may be guided in said pulling sleeve.

The apparatus may include transverse binder means for displaceably guiding said pulling cable.

Said binder means may further include guiding tubes for said pulling cable.

At least the first portion of said pulling cable may be formed substantially of polyarylamide fibers or of synthetic fibers having a low tensile elongation value.

The pulling cable may have a second portion connecting said first portion with said sound generator, said second portion being formed of material having a higher elastic elongation value.

The apparatus may further include a single winch drum on said boat for winding on an off said pulling cable and said floating cables, whereby the ends of the pulling cable and the floating cables are, at their ends close to the boat, mechanically connected to each other.

With a pulling cable of polyarylamide fibers even a high pulling load exerted on the cable during fast travel of the sound generator causes only a small elongation, so that friction of the pulling cable on the less loaded floating cables would be avoided. An elastical coupling of the sound generator with the pulling cable can be obtained by the provision of the second portion of the pulling cable made of elastically elongatable material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
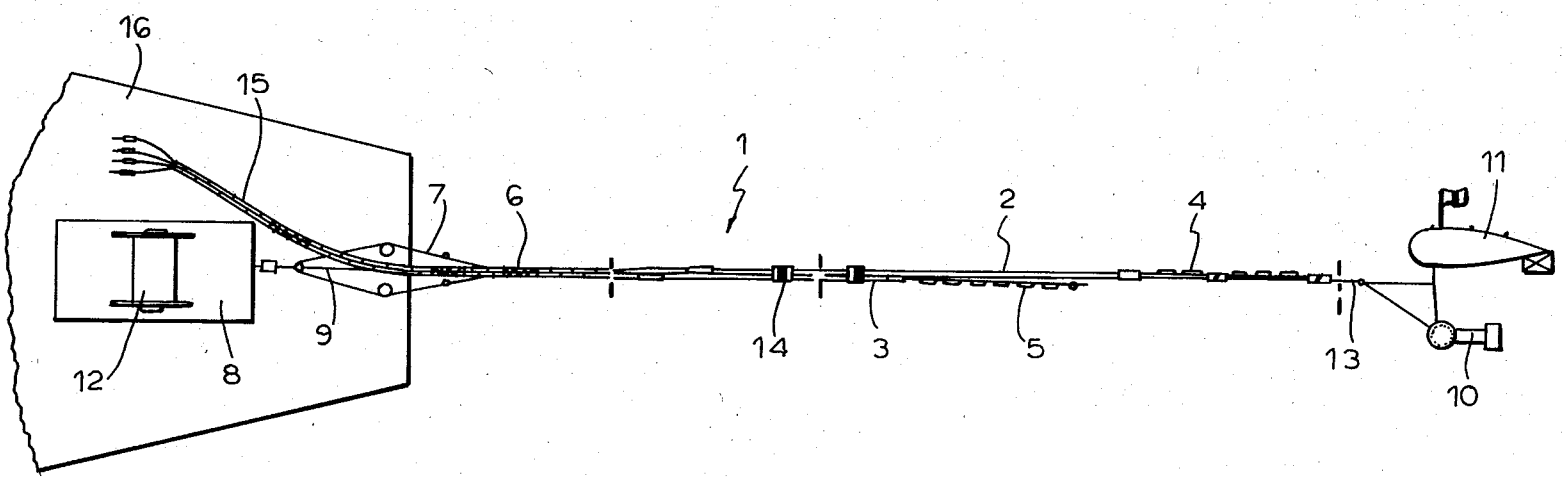
FIG. 1 is a schematic side view of the mine-removing apparatus with electrode-carrying floating cables.

Referring now to the drawings in detail, and firstly to FIG. 1, it will be seen that a mine-removing apparatus 1 includes two floating cables 2, 3 of different length which are provided in their regions remote from the boat with electrodes 4 and 5, respectively. The cables are made buoyant by embedded coak and/or foam material.

Conductor wires extend via a front cable portion 15 from a voltage source positioned on the boat stern 16 through the floating cables 2, 3 to the electrodes 4, 5. The wires are intertwined in the area close to the boat in order to avoid the formation of a mine-igniting field in the vicinity of the boat. The cable portion 15 is provided with a pulling sleeve 6 to which pulling ropes 7 are fixed. These pulling ropes 7 are connected during towing aperation to a base plate 8 provided on the boat stern and are wound about a winch drum for hauling.

Figure 3:
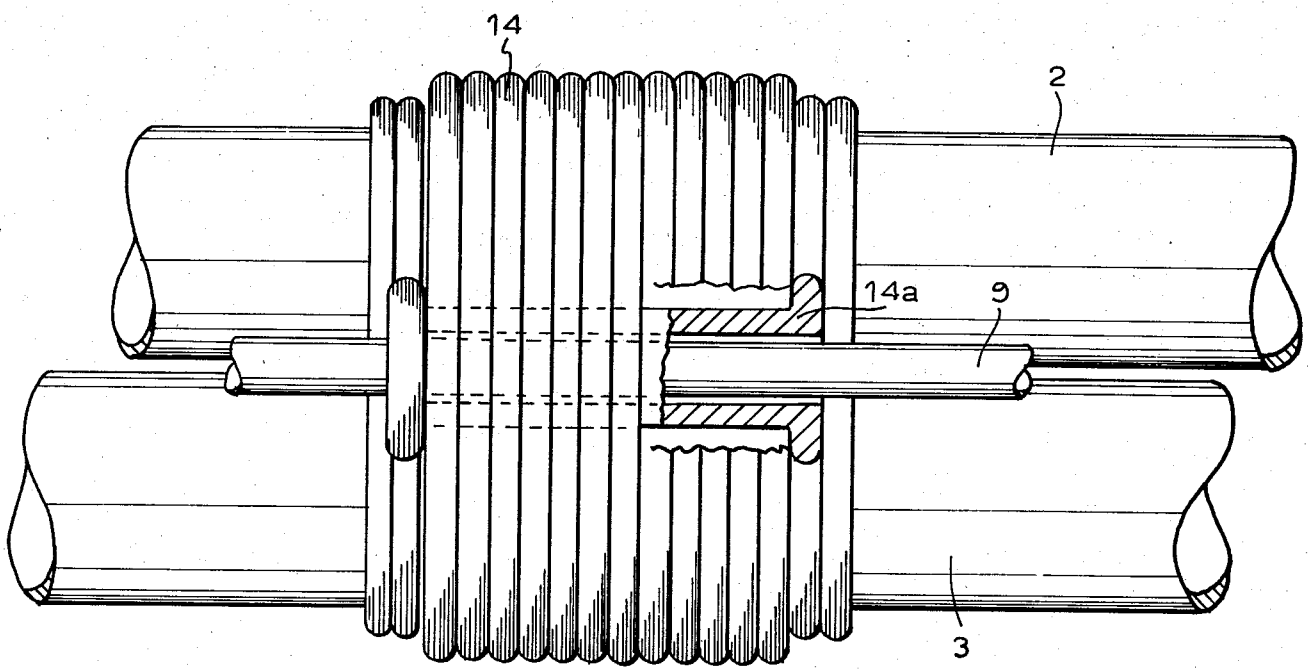
FIG. 3 is a schematic view of a transverse binder.

A pulling cable 9 connected to the pulling ropes 7 extends together with the cable front portion 15 and the floating cables 2, 3 as a common strand in the region near the boat. The pulling cable 9 is longitudinally displaceable relative to the surrounding floating cables 2, 3 and the pulling sleeve 6 and thereby extends like a cable core within the twines of the floating cables. In a region remote from the boat the floating cables 2, 3 are no longer twined around the pulling cable 9 but float freely somewhat parallel besides each other. The pulling cable 9 and floating cables 2, 3 are held together by transverse binders 14. As shown in FIG. 3, the pulling cable 9 is guided in guide tubes 14*a* secured to the transverse binders 14 for relative longitudinal displacement with low friction. The floating cables 2, 3 are loosely supported by the transverse binders 14 for limited longitudinal displacement relative to each other. Instead of being surrounded by the twined floating cables 2, 3, the pulling cable 9 may extend on the side of the floating cables 2, 3 over the entire length thereof being supported thereon for limited longitudinal displacement only through the transverse binders 14.

The portion of the pulling cable 9 extending from the base plate 8 to the trailing end of the floating cable 2 is substantially made of polyarylamide fibers (KEVLAR) so that it has even under high mechanical load only a very small tensile elongation value. Behind the trailing end of the long floating cable 2, there is connected to the portion made of polyarylamide fibers a second portion 13 made of elastically elongatable material which serves to elastically pull the sound generator 10 hung at its trailing end. The sound generator 10 is supported by a float 11.

When the mine-sweeping boat accelerates, the sound generator 10 and the float 11, acting like a drag-anchor, cause a strong sudden load increase on the pulling cable 9, which is cushioned by the elastically elongatable portion 13.

The single winch drum 12 provided on the boat stern serves to put out and pull in the entire mine-removing apparatus. The ends of the pulling cable 9 and the pulling ropes 7 are connected to each other. For hauling the mine-removing apparatus, the pulling cable 9 and the floating cables 2, 3 are wound together on the winch drum 12, wherein the relative longitudinal displaceability of the pulling cable 9 and the floating cables 2, 3 prevents damages of the cables. When putting out the mine-removing apparatus, the single strand including the pulling cable 9 and the floating cables 2, 3 is drawn off the winch drum 12.

During the mine-removing operation, the mine-sweeping boat drags the mine removing apparatus behind its stern as shown schematically in FIG. 1. The voltage applied to electrodes 4, 5 of the floating cables 2, 3 from the voltage source on the boat stern 16 via the cable portion 15, generates a magnetic field lying immediately before the noise source formed by the sound generator 10. Thus, for a ground mine crossed, the mine-removing apparatus is practically not distinguishable from a ship so that the mine will be ignited.

Figure 2:
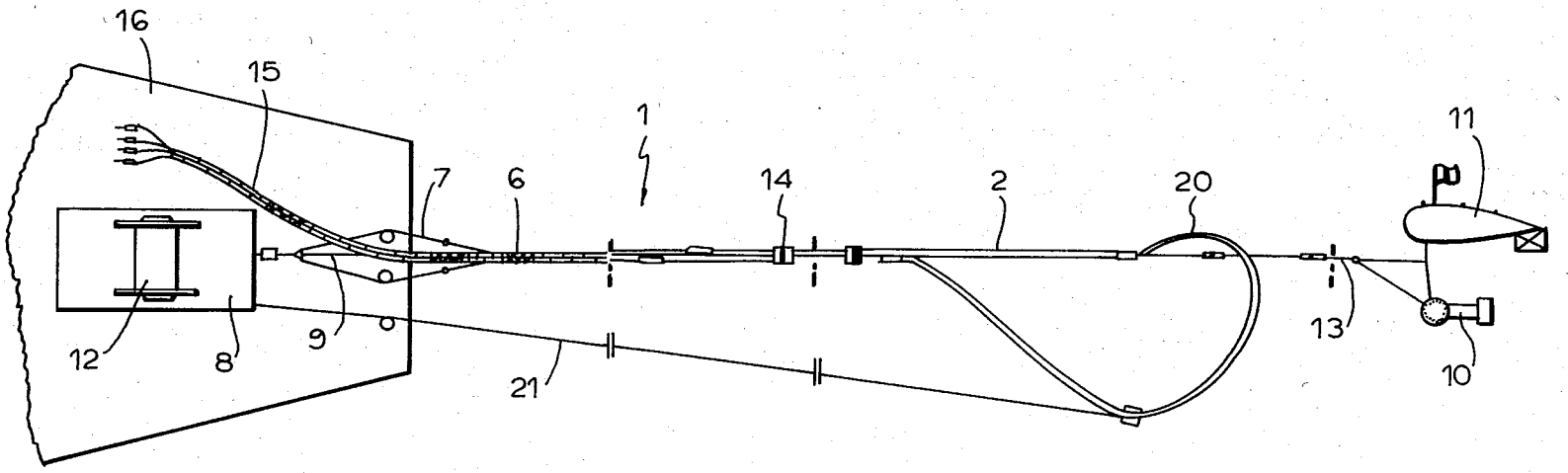
FIG. 2 is a schematic view of a modified mine-removing apparatus with a floating cable loop.

In the modified embodiment shown in FIG. 2, the two electrode-carrying cables are replaced by a closed, electrically-conductive floating cable loop 20, which is connected to the voltage source at the boat stern 16 via the floating cables described in connection with FIG. 1. The current flowing through the floating cable loop 20 generates a magnetic field about this loop, which serves to ignite magnetic ground mines. The position of the floating cable loop 20 is adjustable by means of positioning cable 21 extending from the floating cable loop 20 to the base plate 8. The cables 2 of the floating cable loop 20 are protected by respective means described in connection with FIG. 1 to not create a mine-igniting field in the vicinity of the boat stern 16. Since, the field for igniting magnetic mines lies again in the travel direction of the mine-sweeping boat directly before the sound generator 10, the mines cannot distinguish the mine-removing apparatus from a ship. The handling of the mine-removing apparatus of FIG. 2 is performed by the winch drum 12 on the boat stern 16 in the same fashion as that described for FIG. 1.

It will be understood that each of the elements described above, or two or more together, may also find a useful application in other types of driven mine-removing apparatus differing from the types described above.

While the invention has been illustrated and described as embodiment in a drawn mine-removing apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a mine-removing apparatus to be drawn behind a mine-sweeping boat and comprising a pulling cable, at least one sound generator connected to said pulling cable and adapted for igniting acoustic mines, and electrode-carrying floating cables or an electrically-conductive floating cable loop for igniting magnetic mines, the improvement wherein said pulling cable has a first portion close to the boat, at least said first portion and said floating cables extending as a common strand; said floating cables have a trailing end and said pulling cable has a length extending in operation beyond said trailing end; and said pulling cable and said floating cables are guided for limited longitudinal displacement relative to each other.

2. The apparatus as defined in claim 1, wherein said floating-cables in the region close to the boat are twined around said pulling cable.

3. The apparatus as defined in claim 1, wherein said floating cables have in the region close to the boat a pulling sleeve and said pulling cable is guided in said pulling sleeve.

4. The apparatus as defined in claim 1, further comprising transverse binder means connected said floating cables and displaceably guiding said pulling cable.

5. The apparatus as defined in claim 4, wherein said transverse binder means include guiding tubes for said pulling cable.

6. The apparatus as defined in claim 5, wherein at least the first portion of said pulling cable is formed substantially of polyarylamide fibers.

7. The apparatus as defined in claim 5, wherein at least the first portion of said pulling cable is formed of synthetic fibers having a low tensile elongation value.

8. The apparatus as defined in claim 7, wherein said pulling cable has a second portion connecting said first portion with said sound generator, said second portion being formed of material having a higher elastic elongation value.

9. The apparatus as defined in claim 1, further including a single winch drum on said boat for winding on and off said pulling cable and said floating cables.

* * * * *